US006710270B2

(12) United States Patent
Naimer

(10) Patent No.: US 6,710,270 B2
(45) Date of Patent: Mar. 23, 2004

(54) SWITCH

(76) Inventor: Hubert Laurenz Naimer, Nuvola Bianca, 6612 Ascona (CH)

( * ) Notice: Subject to any disclaimer, the term of this patent is extended or adjusted under 35 U.S.C. 154(b) by 0 days.

(21) Appl. No.: 10/221,533

(22) PCT Filed: Jan. 30, 2001

(86) PCT No.: PCT/AT01/00023

§ 371 (c)(1),
(2), (4) Date: Sep. 13, 2002

(87) PCT Pub. No.: WO01/69621

PCT Pub. Date: Sep. 20, 2001

(65) Prior Publication Data

US 2003/0057066 A1 Mar. 27, 2003

(30) Foreign Application Priority Data

Mar. 16, 2000 (AT) ..... 191/2000 U

(51) Int. Cl.[7] ..... H01H 9/20

(52) U.S. Cl. ..... 200/50.02; 200/50.07; 200/50.1; 200/50.14; 200/50.18

(58) Field of Search ..... 200/50.01–50.07, 200/50.1, 50.12, 50.14, 50.18

(56) References Cited

U.S. PATENT DOCUMENTS

| | | | | | |
|---|---|---|---|---|---|
| 1,565,006 | A | * | 12/1925 | Burns | 200/50.03 |
| 1,821,224 | A | * | 9/1931 | Lewis | 200/50.18 |
| 2,636,955 | A | * | 4/1953 | George | 337/196 |
| 3,141,934 | A | | 7/1964 | Beaudoin | 200/50 |
| 3,179,761 | A | * | 4/1965 | Malota et al. | 200/50.18 |
| 4,496,916 | A | * | 1/1985 | Carpenter et al. | 337/6 |

FOREIGN PATENT DOCUMENTS

| | | | |
|---|---|---|---|
| DE | 34 06 815 | 9/1985 | H01H/85/24 |
| DE | 37 41 743 | 6/1989 | H01H/9/10 |
| DE | 42 04 288 | 8/1992 | H05B/3/22 |
| DE | 42 04 238 | 8/1993 | H02B/1/36 |
| DE | 94 03 039 | 7/1994 | H01H/9/10 |
| DE | 43 07 459 | 9/1994 | H01H/9/10 |
| DE | 197 34 235 | 2/1999 | H01H/85/25 |
| FR | 2 513 006 | 3/1983 | H01H/9/20 |
| GB | 2 180 098 | 3/1987 | H01H/9/22 |

* cited by examiner

*Primary Examiner*—Michael A. Friedhofer
(74) *Attorney, Agent, or Firm*—Collard & Roe, P.C.

(57) ABSTRACT

A combination of a switch which is controllable by a grip and a receiving means for fuses held in a swivelable flap, the switch being provided on a mains side of the receiving means for the fuses and being converted by a housing, the flap being locked with the grip in a closed switching position, the grip of the switch being held in the flap of the receiving means for the fuses, and the grip being insertable on an actuating shaft of the switch merely in an opened position thereof.

3 Claims, 3 Drawing Sheets

SWITCH

CROSS REFERENCE TO RELATED APPLICATIONS

Applicant claims priority under 35 U.S.C. §119 of Austrian Application No. GM 191/2000 filed Mar. 16, 2000. Applicant also claims priority under 35 U.S.C. §365 of PCT/AT01/00023 filed Jan. 30, 2001. The international application under PCT article 21(2) was not published in English.

BACKGROUND OF THE INVENTION

1. Field of the Invention

The invention relates to a combination of a switch and a fuse box.

2. Description of Prior Art

Such combinations are usually provided in order to enable the breaking of the electric circuit before the fuses in the case of the necessity to exchange such fuses. The fuses are constructed with a relatively small size and are provided with electrically conducting caps extending on either side over the jacket surface of said fuses, which caps rests on contact surfaces in the closed state of the receiving means.

In known such combinations the receiving means for the fuses usually assume the function of a switch or disconnector when fuses are inserted. In the closed position of the disconnector the fuses cooperate with contacts on the mains side. This leads to the disadvantage that a respective contact protection of the contacts on the mains side can only be achieved by a relatively complex mechanism in the opened state of the combination or the fixing device for the fuses.

From DE 94 03 039 U a switching arrangement provided with fuses is known which allows the exchange of fuses only when the fuse flap is opened, i.e. only in the no-load state. Moreover, the opening of the flap is only possible in the no-load state, i.e. the switch must be in the opened position during the opening of the flap. The switching arrangement does not prevent, however, that the switch is closed in the opened position of the flap and thereafter the fuse flap is closed, as a result of which an arc would be produced.

From GB 2 180 098 A a fuse box is known with a switch and an actuating shaft on which a grip can be inserted. The grip can be connected with a door of the fuse box. In the closed position of the switch the grip cannot be withdrawn from the actuating shaft and thus the door cannot be opened. This merely concerns a simple locking mechanism of the fuse box door. The exchange of fuses under load cannot be prevented in this manner.

SUMMARY OF THE INVENTION

It is therefore the object of the present invention to avoid this disadvantage and to provide a combination of the kind mentioned above which is characterized by a simple arrangement.

This is achieved in accordance with the invention in a combination of the of a switch which is controllable by a grip and a receiving means for fuses held in a swivelable flap, the switch being provided on a mains side of the receiving means for the fuses and being covered by a housing, the flap being locked with the grip in a closed switching position, the grip of the switch being held in the flap of the receiving means for the fuses, and the grip being insertable on an actuating shaft of the switch merely in an opened thereof.

The proposed measures ensure that an exchange of fuses is only possible when the switch is in its off position. Since the switch itself is provided with a respective housing, a secure shock-hazard protection is ensured. The shock-hazard protection is achieved in a very simple manner, namely by the arrangement of the switch.

The grip held in the flap can only be uncoupled from the switch in the position corresponding to the opened position of the switch, which is necessary for opening the flap receiving the fuses. Since the grip is an integral part of the flap, the switch cannot be actuated when the flap is opened and when the fuses are accessible. This ensures that the fuses are exchanged always in the no load state and the switch can only be actuated when the flap is closed.

The grip may overlap a free edge of the flap for receiving the fuse in a position corresponding to the closed switching position. The grip is appropriately arranged as a toggle.

BRIEF DESCRIPTION OF THE DRAWING

The subclaims describe preferred embodiments of the invention.

The invention is now explained in closer detail by reference to the enclosed drawing, wherein.

DETAILED DESCRIPTION OF THE PREFERRED EMBODIMENT

Figure 1:
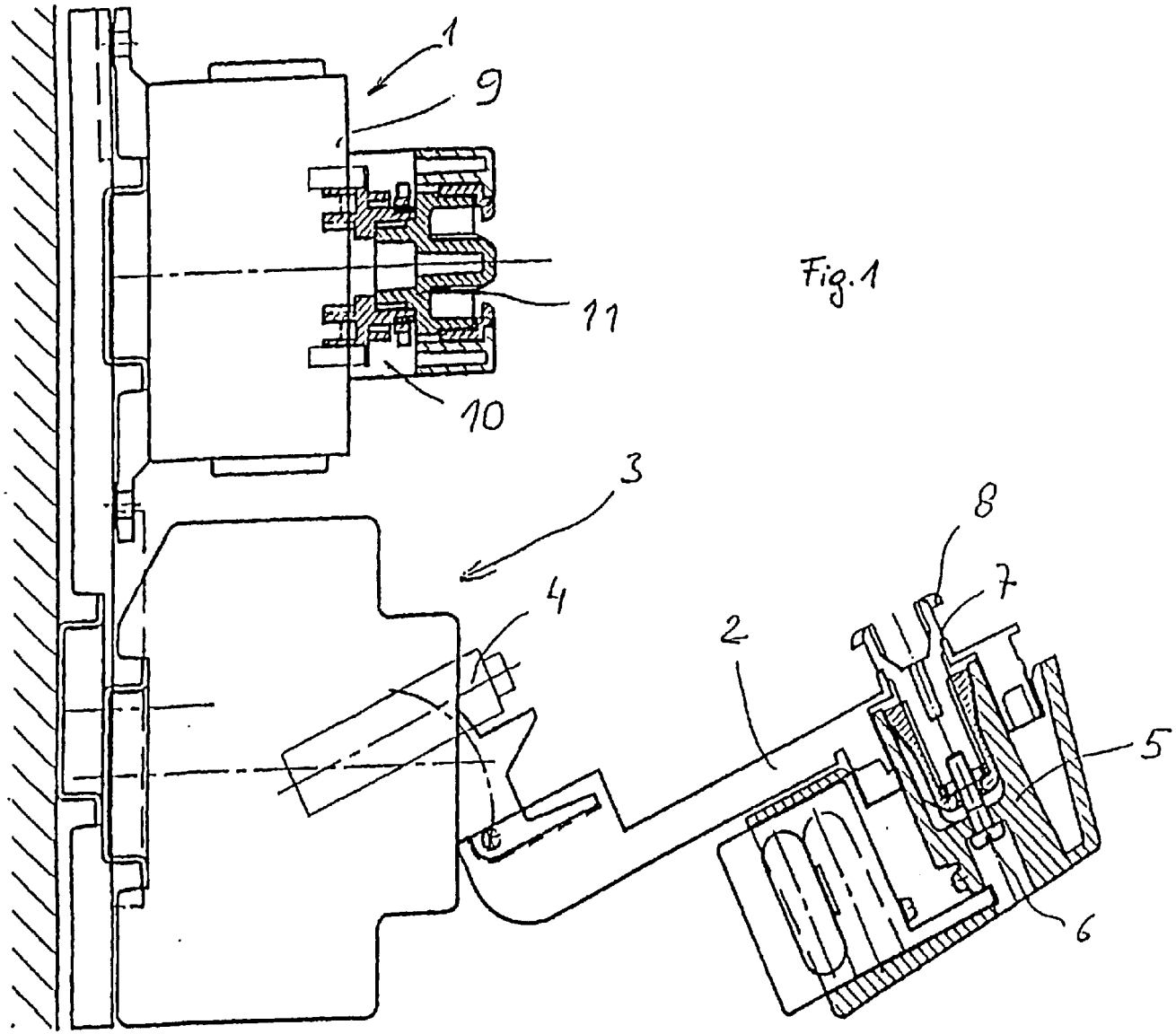
FIG. 1 schematically shows a combination in accordance with the invention with opened receiving means of the fuses.

The combination according to FIG. 1 comprises a switch 1 which is arranged on the mains side on a fixing device 3 for fuses 4, which fixing device comprises a flap 2.

A grip 5 is rotatably held in the flap 2, which grip is connected with a hollow shaft 7 by means of a screw 6, which shaft is provided in the zone of its free end in sections with outwardly facing flange-like projections 8.

Switch 1 is provided with a housing 9 which is provided with a fore-part 10 in which an actuating shaft 11 is held rotatably.

Figure 2:
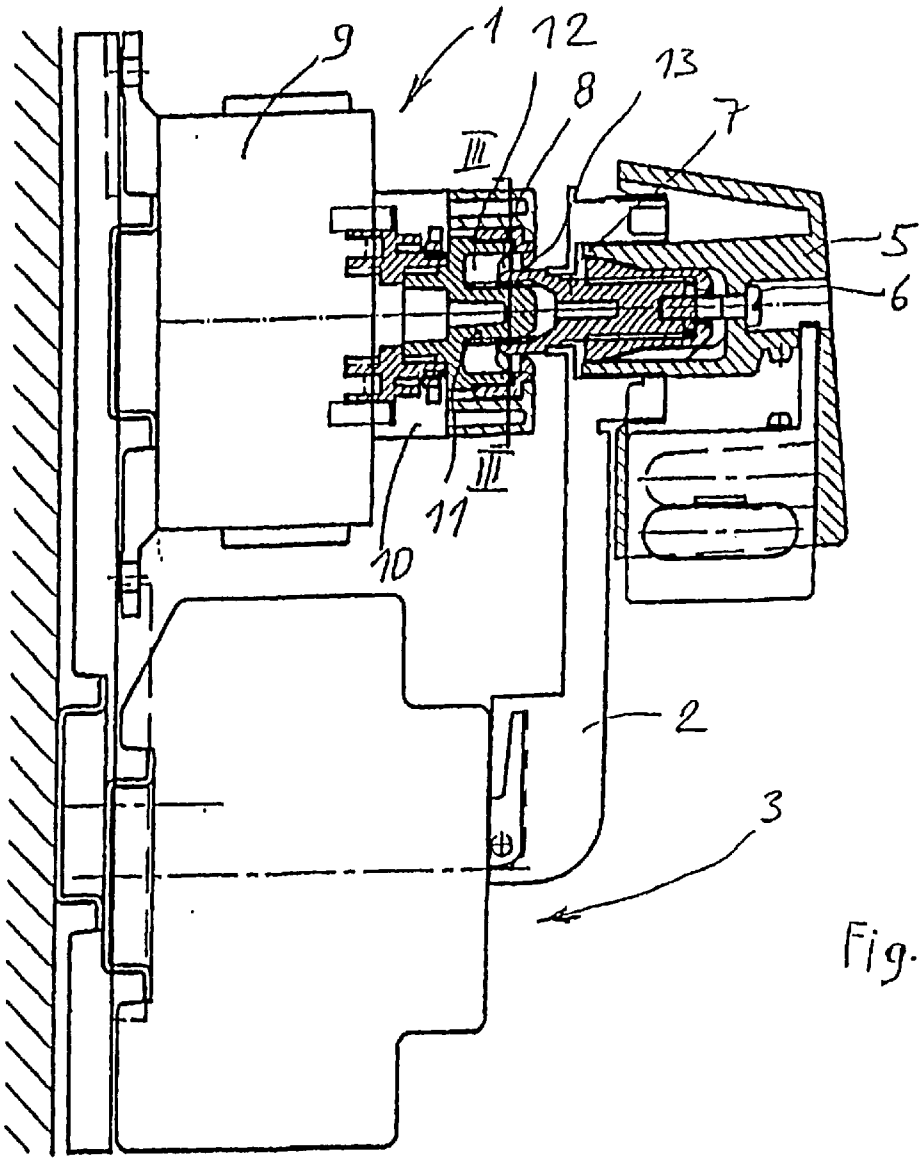
FIG. 2 shows the combination in the closed state.
Figure 3:
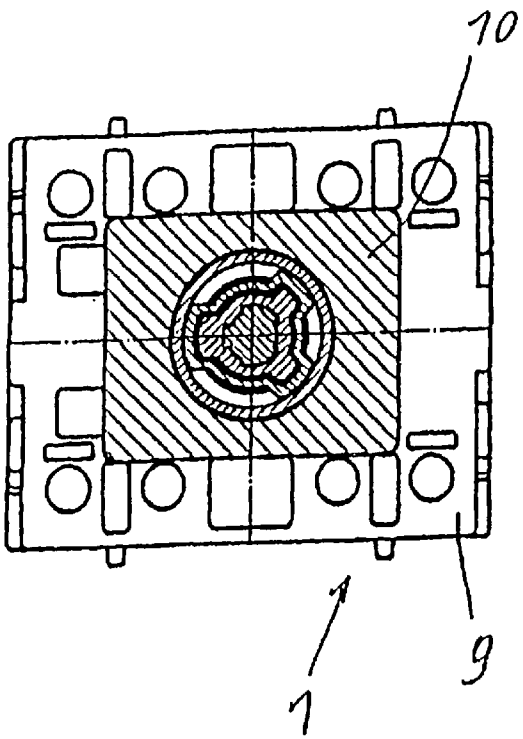
FIG. 3 shows a sectional view through a part of the combination along line III—III in FIG. 2.
Figure 4:
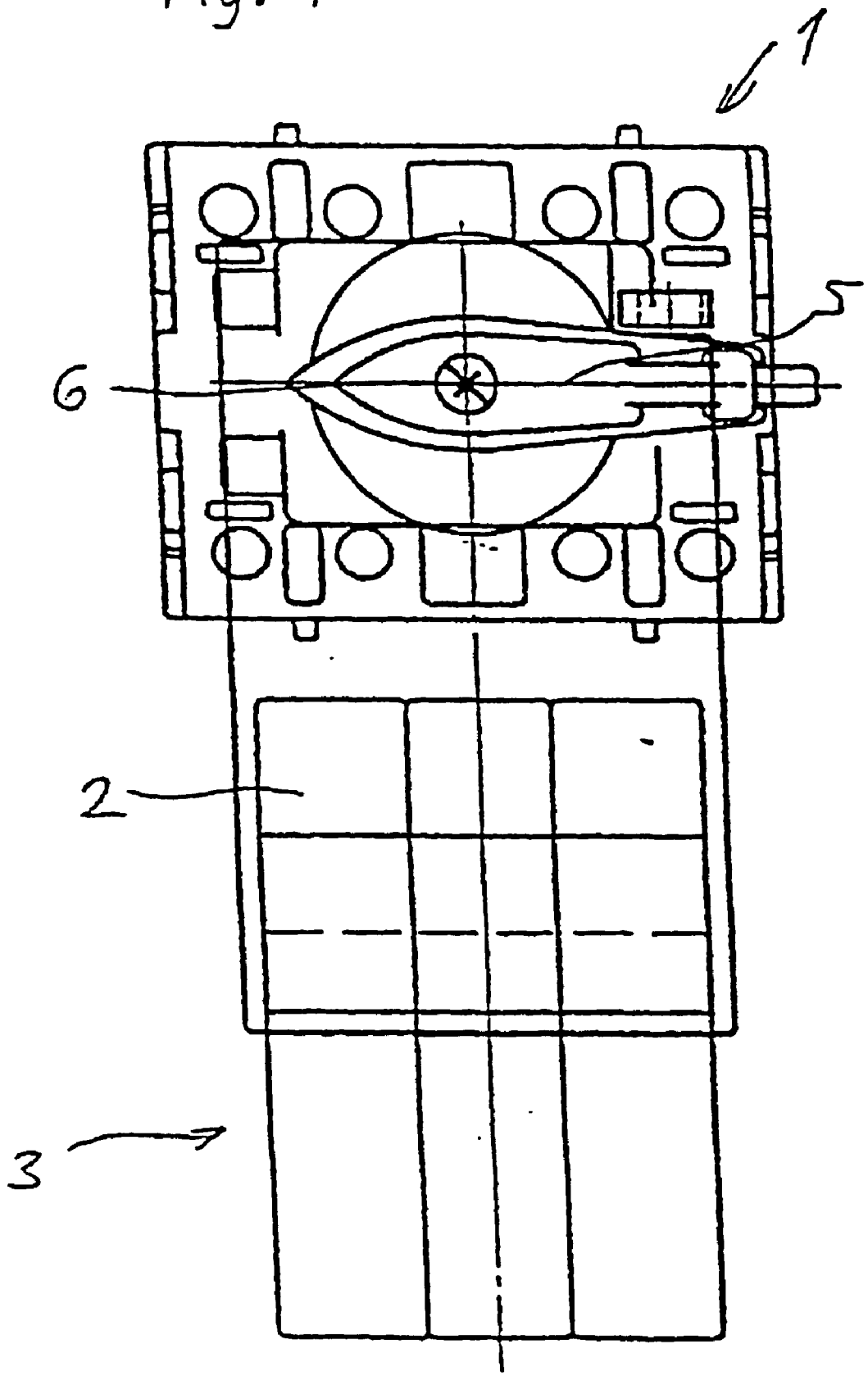
FIG. 4 shows a view of the combination when the switch is opened.

As can be seen from FIG. 2, the flap 2 can be swiveled upwardly, with the hollow shaft 7 of grip 5 being inserted on the actuating shaft 11.

This is only possible, however, when the actuating shaft 11 is situated in a position corresponding to the opened switch 9 and the grip 5 is held in a position corresponding to the opened position of switch 9.

The edge of the fore-part 10 of housing 9 of switch 1, which edge delimits an opening 12 which encloses the free end of the actuating shaft 11, is provided with sections which are undercut over sections. The flange-like projections 8 of the hollow shaft 7 can be inserted into the intermediate spaces between the undercut zones 13 of the edge of opening 12 when the grip is situated in the opened position of switch 1. This allows a coupling of the grip 5 with the actuating shaft 11 under the condition that the actuating shaft 11 is situated in the position corresponding to the opened switching state of switch 1.

If the grip 5 is twisted thereafter and thus the switch 1 is closed, the flange-like projections 8 of the hollow shaft 7 of the grip 5 grasp behind the undercut zones 13 of the fore-part

10 of housing 9 of the switch, so that the flap 2 can no longer be flipped open. This ensures, that the same cannot be opened when switch 1 is closed.

What is claimed is:

1. A combination of a switch which is controllable by a grip and a receiving means for fuses held in a swivelable flap the switch being provided on a mains side of the fuses and being covered by a housing the flap being locked with the grip in a closed switching position, characterized in that the grip (5) of the switch being held in the flap of the receiving means for the fuses, and the grip being insertable on an actuating shaft of the switch merely in an opened position thereof.

2. A combination as claimed in claim 1, characterized in that wherein the grip comprises a profiled hollow shaft which comprises at a free end thereof and outwardly facing flange-like sections insertable between undercut zones of an edge of an opening of the housing of the switch for receiving the grip (5).

3. A combination as claimed in claim 1, wherein the grip of the switch overlaps a free edge of the flap for receiving the fuses in a position corresponding to the closed switching position.

* * * * *